US005213631A

United States Patent [19]

Akioka et al.

[11] Patent Number: 5,213,631

[45] Date of Patent: May 25, 1993

[54] RARE EARTH-IRON SYSTEM PERMANENT MAGNET AND PROCESS FOR PRODUCING THE SAME

[75] Inventors: Koji Akioka; Osamu Kobayashi, both of Suwa; Tatsuya Shimoda, Nagano, all of Japan

[73] Assignee: Seiko Epson Corporation, Tokyo, Japan

[21] Appl. No.: 768,802

[22] Filed: Sep. 30, 1991

Related U.S. Application Data

[63] Continuation of Ser. No. 298,608, Oct. 31, 1988, Pat. No. 5,125,988.

[30] Foreign Application Priority Data

Mar. 2, 1987 [JP] Japan ..... 62-47042
Mar. 1, 1988 [WO] PCT Int'l Appl. ... PCT/JP88/00225

[51] Int. Cl.[5] ..... H01F 1/053
[52] U.S. Cl. ..... 148/302; 252/62.54
[58] Field of Search ..... 148/302; 420/83, 121; 252/62.54

[56] References Cited

U.S. PATENT DOCUMENTS

| | | | |
|---|---|---|---|
| 4,767,474 | 8/1988 | Fujimura et al. | 148/302 |
| 4,773,950 | 9/1988 | Fujimura et al. | 148/302 |
| 4,842,656 | 6/1989 | Maines et al. | 148/302 |
| 4,902,361 | 2/1990 | Lee et al. | 148/302 |
| 4,921,553 | 5/1990 | Tokunaga et al. | 148/302 |
| 4,952,239 | 8/1990 | Tokunaga et al. | 148/302 |
| 4,983,232 | 1/1991 | Endoh et al. | 148/302 |
| 5,049,208 | 9/1991 | Yajima et al. | 148/302 |

FOREIGN PATENT DOCUMENTS

| | | | |
|---|---|---|---|
| 0144112 | 6/1985 | European Pat. Off. . | |
| 0174735 | 3/1986 | European Pat. Off. . | |
| 56-47538 | 4/1981 | Japan | 148/101 |
| 59-132105 | 7/1984 | Japan . | |
| 60-63304 | 4/1985 | Japan . | |
| 61-268006 | 5/1985 | Japan . | |
| 60-152008 | 8/1985 | Japan . | |
| 60-218457 | 11/1985 | Japan . | |
| 61-119005 | 6/1986 | Japan | 148/101 |
| 61-225814 | 10/1986 | Japan . | |
| 61-238915 | 10/1986 | Japan | 148/101 |
| 62-101004 | 5/1987 | Japan . | |
| 62-216203 | 9/1987 | Japan . | |

OTHER PUBLICATIONS

Chemical Abstracts, Kononenko, et al., "Effect of Heat Treatment on the Coercive Force of Neodymium-Iron-Boron Alloyt Magents", vol. 104, No. 24, p. 705, Jun. 1986.

*Primary Examiner*—John P. Sheehan
*Attorney, Agent, or Firm*—Blum Kaplan

[57] ABSTRACT

A rare earth-iron permanent magnet which is formed from an ingot of an alloy composed of at least one rare earth element represented by R, Fe, B and Cu, by the hot working at 500° C. or above which refines the crystal grains and make them magnetically anisotropic. A process for producing a rare earth-iron permanent magnet by subjecting the ingot of said alloy to hot working at 500° C. or above. The permanent magnet is equal or superior in magnetic performance to conventional permanent magnets produced by sintering method. The process is simple and able to provides permanent magnets of low price and high performance. In addition, an isotropic rare earth-iron permanent magnet is obtained if said ingot undergoes heat treatment at 250° C. or above.

24 Claims, No Drawings

RARE EARTH-IRON SYSTEM PERMANENT MAGNET AND PROCESS FOR PRODUCING THE SAME

This is a continuation of application Ser. No. 07/298,608, filed Oct. 31, 1988 now U.S. Pat. No. 5,125,988.

TECHNICAL FIELD

The present invention relates to a rare earth-iron permanent magnet composed mainly of rare earth elements and iron, and also to a process for producing the same.

BACKGROUND ART

The permanent magnet is one of the most important electrical and electronic materials used in varied application areas ranging from household electric appliances to peripheral equipment of large computers. There is an increasing demand for permanent magnets of high performance to meet a recent requirement for making electric appliances smaller and more efficient than before.

Typical of permanent magnets now in use are alnico magnets, hard ferrite magnets, and rare earth-transition metal magnets. Much has been studied on rare earth-cobalt permanent magnets and rare earth-iron permanent magnets, which belong to the category of the rare earth-transition metal magnets, because of their superior magnetic performance. Rare earth-iron permanent magnets are attracting attention on account of their lower price and higher performance than rare earth-cobalt permanent magnets which contain a large amount of expensive cobalt.

Heretofore, there have been rare earth-iron permanent magnets produced by any of the following three processes.

(1) One which is produced by the sintering process based on the powder metallurgy. (See Japanese Patent Laid-open No. 46008/1984.)

(2) One which is produced by binding thin ribbons (about 30 μm thick) with a resin. Thin ribbons are produced by rapidly quenching the molten alloy using an apparatus for making amorphous ribbons (See Japanese Patent Laid-open No. 211549/1984.)

(3) One which is produced from the thin ribbons (produced as mentioned in (2) above) under mechanical orientation by the two-stage hot pressing method. (See Japanese Patent Laid-open No. 100402/1985.)

The present inventors previously proposed a magnet produced from a cast ingot which has undergone mechanical orientation by the one-stage hot working. (See Japanese Patent Application No. 144532/1986 and Japanese Patent Laid-open No. 276803/1987.) (This process is referred to as process (4) hereinafter.)

The above-mentioned process (1) includes the steps of producing an alloy ingot by melting and casting, crushing the ingot into magnet powder about 3 μm in particle size, mixing the magnet powder with a binder (molding additive), press-molding the mixture in a magnetic field, sintering the molding in an argon atmosphere at about 1100° C. for 1 hour, and rapidly cooling the sintered product to room temperature. The sintered product undergoes heat treatment at about 600° C. to increase coercive force.

In the above-mentioned process (2) rapidly cooled thin ribbons of R-Fe-B alloy are produced by a melt-spinning apparatus at an optimum substrate velocity.

The rapidly cooled thin ribbon is about 30 μm thick and is an aggregation of crystal grains 1000 Å or less in diameter. It is brittle and liable to break. It is magnetically isotropic because the crystal grains are distributed isotropically. To make a magnet, this thin ribbon is crushed into powder of proper particle size, the powder is mixed with a resin, and the mixture undergoes press molding.

According to the above-mentioned process (3), the thin ribbon obtained by the process (2) undergoes mechanical orientation by a two-stage hot pressing in vacuum or an inert gas atmosphere. Thus there is obtained a anisotropic R-Fe-B magnet. In the pressing stage, pressure is applied in one axis so that the axis of easy magnetization is aligned in the direction parallel to the pressing direction. This alignment process brings about anisotropy. This process is executed such that the crystal grains in the thin ribbon has a particle diameter smaller than that of crystal grains which exhibit the maximum coercive force, and then the crystal grains are desinged to grow to a optimum particle diameter during hot-pressing.

The above-mentioned process (4) is designed to produce and anisotropic R-Fe-B magnet by hot-working an alloy ingot in vacuum or an inert gas atmosphere. The process causes the axis of easy magnetization to align in the direction parallel to the working direction, resulting in anisotropy, as in the above-mentioned process (3). However, process (4) differs from process (3) in that the hot working is performed in only one stage and the hot working makes the crystal grains smaller.

The above-mentioned prior art technologies enable to produce the rare earth-iron permanent magnets; but they have some drawbacks as mentioned below.

A disadvantage of process (1) stems from the fact that it is essential to finely pulverize the alloy. Unfortunately, the R-Fe-B alloy is so active to oxygen that pulverization causes severe oxidation, with the result that the sintered body unavoidably contains oxygen in high concentrations. Another disadvantage of process (1) is that the powder molding needs a molding additive such as zinc stearate. The molding additive is not able to be removed completely in the sintering step but partly remains in the form of carbon in the sintered body. This residual carbon considerably deteriorates the magnetic performance of the R-Fe-B permanent magnet. An additional disadvantage of process (1) is that the green compacts formed by pressing the powder mixed with a molding additive are very brittle and hard to handle. Therefore, it takes much time to put them side by side regularly in the sintering furnace.

On account of these disadvantages, the production of sintered R-Fe-B magnets needs an expensive equipment and suffers from poor productivity. This leads to a high production cost, which offsets the low material cost.

A disadvantage of processes (2) and (3) is that they need a melt-spinning apparatus which is expensive and poor in productivity. Moreover, process (2) provides a permanent magnet which is isotropic in principle. The isotropic magnet has a low energy product and a hysteresis loop of poor squareness. It is also disadvantageous in temperature characteristics for practical use.

A disadvantage of process (3) is poor efficiency in mass production which results from performing hot-pressing in two stages. Another disadvantage is that hot-pressing at 800° C. or above causes coarse crystal grains, which lead to a permanent magnet of impractical use on account of an extremely low coercive force.

The above-mentioned process (4) is the simplest among the four processes; it needs no pulverization step but only one step of hot working. Nevertheless, it has a disadvantage that it affords a permanent magnet which is a little inferior in magnetic performance to those produced by process (1) or (3).

DISCLOSURE OF THE INVENTION

The present invention was completed to eliminate the above-mentioned disadvantages, especially the disadvantage of process (4) in affording a permanent magnet poor in magnetic performance. Therefore, it is an object of the present invention to provide a rare earth-iron permanent magnet of high performance and low price.

The gist of the present invention resides in a rare earth-iron permanent magnet which is formed from an ingot of an alloy composed of at least one rare earth element represented by R, Fe, and B as major components and Cu as a minor component, by hot working at 500° C. or above which finely refine the crystal grains and aligns their crystalline axis in a specific direction, thereby making them magnetically anisotropic.

According to the present invention, the thus formed permanent magnet may undergo heat treatment at 250° C. or above before and/or after the hot working, for the improvement of coercive force. If the above-mentioned ingot undergoes heat treatment at 250° C. or above, there is obtained an isotropic permanent magnet having an improved coercive force.

The above-mentioned alloy has a composition represented by the chemical formula of RFeBCu. The alloy should preferably be composed of 8 to 30% (atomic percent) of R, 2 to 28% of B, and less than 6% of Cu, with the remainder being Fe and unavoidable impurities. It is permissible to replace less than 50 atomic percent of Fe with Co for the improvement of temperature characteristics. It is also permissible to add less than 6 atomic percent of one or more than one element selected from Ga, Al, Si, Bi, V, Nb, Ta, Cr, Mo, W, Ni, Mn, Ti, Zr, and Hf for the improvement of magnetic characteristics. The alloy may contain less than 2 atomic percent of S, less than 4 atomic percent of C, and less than 4 atomic percent of P as unavoidable impurities.

According to the present invention, a resin-bonded permanent magnet is formed from a finely pulverized powder of the alloy and an organic binder mixed together. The pulverization is accomplished by utilizing the property of the alloy which is characterized by that the crystal grains become finer during hot working, with or without hydrogen decrepitation. The thus pulverized powder may be surface-coated by physical or chemical deposition.

The above process (4) is intended to produce anisotropic magnets by subjecting an ingot to hot working, as mentioned above. An advantage of this process is that it obviates the eliminates the pulverizing step and using the molding additive, with the result that the magnet contains oxygen and carbon in very low concentrations. In addition, the process is very simple. However, the magnet produced by this process is inferior in magnetic property to those produced by the processes (1) and (3), on account of the poor alignment of crystalline axis.

To eliminate this disadvantage, the present inventors investigated the elements to be added and found that Cu greatly contributes to the increased degree of alignment.

Adding Cu to R-Fe-B alloys is already disclosed in Japanese Patent Laid-open No. 132105/1984. However, according to this disclosure, Cu is not regarded as an element to be added positively for the improvement of magnetic properties. Rather, it is regarded as one of unavoidable impurities which enters when cheap Fe of low purity is used, and it is also regarded as a substance which deteriorates the magnetic properties, contrary to the finding in the present invention. In fact, the patent discloses that the magnetic properties decrease to about 10 MGOe in $(BH)_{max}$ when it contains only 1 atomic percent of Cu. On the other hand, according to the present invention, Cu is added positively to improve the magnetic properties to a great extent. It is in this significance that the present invention is entirely different from the above-mentioned laid-open Japanese Patent.

The actual effect produced by the addition of Cu is explained in the following. The magnet in the present invention has an increased energy product and coercive force on account of Cu added, regardless of whether the magnet is produced from an ingot by simple heat treatment without hot working, or the magnet is produced from an ingot by hot working to bring about anisotropy. The effect of Cu is widely different from that of other elements (such as Dy) which are effective in increasing coercive force. In the case of Dy, the increase of coercive force takes place because Dy forms an intermetallic compound of $R_{2-x}Dy_xFe_{14}B$, replacing the rare earth element of the main phase in the magnet pertaining to the present invention, consequently increasing the anisotropic magnetic field of the main phase. By contrast, Cu does not replace Fe in the main phase but coexists with the rare earth element in the rare earth-rich phase at the grain boundary.

As known well, the coercive force of R-Fe-B magnets is derived very little from the $R_2Fe_{14}B$ phase as the main phase; but it is produced only when the main phase coexists with the rare earth-rich phase as the grain boundary phase. It is known that other elements (such as Al, Ga, Mo, Nb, and Bi) besides Cu increase coercive force. However, it is considered that they do not affect the main phase directly but affect the grain boundary phase. Cu is regarded as one of such elements. The addition of Cu changes the structure of the alloy after casting and hot working. The change occurs in two manners as follows:

(1) The refining crystal grains at the time of casting.
(2) The formation of the uniform structure after working which is attributable to improved work-ability.

The R-Fe-B magnet produced by the above-mentioned process (4) is considered to produce coercive force by the mechanism of nucleation in view of the sharp rise of the initial magnetization curve. This means that the coercive force depends on the size of crystal grains. In other words, Cu increases the coercive force of a cast magnet because the crystal grain size in a cast magnet is determined at the time of casting.

The R-Fe-B magnet has the improved hot working characteristics attributable to the rare earth-rich phase. In other words, this phase helps particles to rotate, thereby protecting particles from being broken by working. Cu coexists with the rare earth-rich phase, lowering the melting point thereof. Presumably, this leads to the improved workability, the uniform structure after working, and the increased degree of alignment of crystal grains in the pressing direction.

The permanent magnet of the present invention should have a specific composition for reasons explained in the following. It contains one or more than one rare earth element selected form Y, La, Ce, Pr, Nd, Sm, Eu, Gd, Tb, Dy, Ho, Er, Tm, Yb, and Lu. Pr produces the maximum magnetic performance. Therefore, Pr, Nd, Pr-Nd alloy, and Ce-Pr-Nd alloy are selected for practical use. A small amount of heavy rare earth elements such as Dy and Tb is effective in the enhancement of coercive force. The R-Fe-B magnet has the main phase of $R_2Fe_{14}B$. With R less than 8 atomic %, the magnet does not contain this compound but has the structure of the same body centered cubic α-iron. Therefore, the magnet does not exhibit the high magnetic performance. Conversely, with R in excess of 30 atomic %, the magnet contains more non-magnetic R-rich phase and hence is extremely poor in magnetic performance. For this reason, the content of R should be 8 to 30 atomic %. For cast magnets, the content of R should preferably be 8 to 25 atomic %.

B is an essential element to form the $R_2Fe_{14}B$ phase. With less than 2 atomic %, the magnet forms the rhombohedral R-Fe structure and hence produces only a small amount of coercive force. With more than 28 atomic %, the magnet contains more non-magnetic B-rich phase and hence has an extremely low residual flux density. In the case of cast magnets, the adequate content of B is less than 8 atomic %. With B more than this limit, the cast magnet has a low coercive force because it does not possess the $R_2Fe_{14}B$ phase of fine structure unless it is cooled in a special manner.

Co effectively raises the curie point of the rare earth-iron magnet. Basically, it replaces the site of Fe in $R_2Fe_{14}B$ to form $R_2Co_{14}B$. As the amount of this compound increases, the magnet as a whole decreases in coercive force because it produces only a small amount of crystalline anisotropic magnetic field. Therefore, the allowable amount of Co should be less than 50 atomic % so that the magnet has a coercive force greater than 1 kOe which is necessary for the magnet to be regarded as a permanent magnet.

Cu contributes to the refinement of columnar structure and the improvement of hot working characteristics, as mentioned above. Therefore, it causes the magnet to increase in energy product and coercive force. Nevertheless, the amount of Cu in the magnet should be less than 6 atomic % because it is a non-magnetic element and hence it lowers the residual flux density when it is excessively added to the magnet.

Those elements, in addition to Cu, which increase coercive force include Ga, Al, Si, Bi, V, Nb, Ta, Cr, Mo, W, Ni, Mn, Ti, Zr, and Hf. Any of these 15 elements should be added to the R-Fe-B alloy in combination with Cu for a synergistic effect, instead of being added alone. All of these elements except Ni do not affect the main phase directly but affect the grain boundary phase. Therefore, they produce their effect even when used in comparatively small quantities. The adequate amount of these elements except Ni is less than 6 atomic %. When added more than 6 atomic %, they lower the residual flux density as in the case of Cu. (Ni can be added as much as 30 atomic % without a considerable loss of overall magnetic performance, because it forms a solid solution with the main phase. The preferred amount of Ni is less than 6 atomic % for a certain magnitude of residual flux density.) The above-mentioned 15 elements may be added to the R-Fe-B-Cu alloy in combination with one another.

The magnet of the present invention may contain other elements such as S, C, and P as impurities. This permits a wide range of selection for raw materials. For example, ferroboron which usually contains C, S, P, etc. can be used as a raw material. Such a raw material containing impurities leads to a considerable saving of raw material cost. The content of S, C, and P in the magnet, however, should be less than 2.0 atomic %, 4.0 atomic %, and 4.0 atomic %, respectively, because such impurities reduce the residual flux density in proportion to their amount.

The magnet of the present invention is free of the disadvantage involved in magnets produced by the casting process or process (4) mentioned above, and has improved magnetic performance comparable to that of magnets produced by the sintering process or process (1) mentioned above. The process of the present invention is simple, taking advantage of the feature of the casting process, and also permits the production of anisotropic resin-bonded permanent magnets. Thus the present invention greatly contributes to the practical use of permanent magnets of high performance and low price.

BEST MODE FOR CARRYING OUT THE INVENTION

EXAMPLE 1

An alloy of desired composition was molten in an induction furnace and the melt was cast in a mold. The resulting ingot underwent various kinds of hot working so that the magnet was given anisotropy. In this example, there was employed the liquid dynamic compaction method for casting which produces fine crystal grains on account of rapid cooling. (Refer to T. S. Chin et al. J. Appl. Phys. 59(4), Feb. 15, 1986, p. 1297.) The hot working used in this example includes (1) extrusion, (2) rolling., (3) stamping, and (4) pressing, which were carried out at 1000° C. Extrusion was performed in such a manner that force is applied also from the die so that the work receives force isotropically. Rolling and stamping were carried out at a proper speed so as to minimize the strain rate. The hot working aligns the axis of easy magnetization of crystals in the direction parallel to the direction in which the alloy is worked.

Table 1 below shows the composition of the alloy and the kind of hot working employed in the example. After hot working, the work was annealed at 1000° C. for 24 hours.

The results are shown in Table 2. For comparison, the residual flux density of the sample without hot working is given in the rightmost column of Table 2.

TABLE 1

| No. | Composition | Hot working |
|---|---|---|
| 1 | $Nd_{18}Fe_{34}B_8$ | Extrusion |
| 2 | $Nd_{15}Fe_{77}B_8$ | Rolling |
| 3 | $Pr_{22}Fe_{70}B_8$ | Pressing |
| 4 | $Pr_{30}Fe_{62}B_8$ | Extrusion |
| 5 | $Nd_{15}Fe_{83}B_2$ | Rolling |
| 6 | $Nd_{15}Fe_{81}B_4$ | Pressing |
| 7 | $Nd_{15}Fe_{70}B_{15}$ | Stamping |
| 8 | $Nd_{15}Fe_{57}B_{28}$ | Pressing |
| 9 | $Nd_{22}Fe_{58}B_{10}$ | Stamping |
| 10 | $Nd_{30}Fe_{35}B_{15}$ | Extrusion |
| 11 | $Co_3Nd_3Pr_5Fe_{73}B_8$ | Rolling |
| 12 | $Pr_{15}Fe_{72}Co_5B_8$ | Extrusion |
| 13 | $Pr_{15}Fe_{87}Co_{10}B_8$ | Pressing |
| 14 | $Nd_{17}Fe_{80}Co_{15}B_8$ | Stamping |
| 15 | $Nd_{17}Fe_{45}Co_{30}B_8$ | Rolling |
| 16 | $Pr_{15}Fe_{27}Co_{50}B_8$ | Stamping |
| 17 | $Pr_{15}Fe_{72}Al_5B_8$ | Pressing |
| 18 | $Nd_{15}Fe_{87}Al_{10}B_8$ | Extrusion |
| 19 | $Nd_{15}Fe_{82}Al_{15}B_8$ | Rolling |

TABLE 1-continued

| No. | Composition | Hot working |
|---|---|---|
| 20 | $Nd_{15}Fe_{50}Co_{12}Al_5B_8$ | Rolling |
| 21 | $Nd_{10}Pr_7Fe_{35}Co_{15}Al_3B_8$ | Stamping |
| 22 | $Pr_{15}Fe_{75}Cu_2B_8$ | Pressing |
| 23 | $Pr_{15}Fe_{83}Co_{10}Cu_4B_8$ | Extrusion |
| 24 | $Pr_{15}Fe_{71}Cu_8B_8$ | Pressing |
| 25 | $Pr_{13}Fe_{75}Ga_2B_8$ | Extrusion |
| 26 | $Pr_{15}Fe_{83}Co_{10}Ga_4B_8$ | Pressing |
| 27 | $Nd_{15}Fe_{30}Co_{12}Ga_8B_8$ | Extrusion |
| 28 | $Pr_{15}Fe_{74}Cu_{1.5}Ga_{1.3}B_8$ | Pressing |

TABLE 2

| No. | Br(KG) | BHC(KOe) | $(BH)_{max}$(MGOe) | Br(KG)* |
|---|---|---|---|---|
| 1 | 8.9 | 2.3 | 4.9 | 0.8 |
| 2 | 10.5 | 5.3 | 12.5 | 2.3 |
| 3 | 8.9 | 5.0 | 10.0 | 2.0 |
| 4 | 7.6 | 3.8 | 5.8 | 0.8 |
| 5 | 8.5 | 2.4 | 4.5 | 0.8 |
| 6 | 12.3 | 8.4 | 23.2 | 1.5 |
| 7 | 7.9 | 4.8 | 7.6 | 0.9 |
| 8 | 7.0 | 2.8 | 3.9 | 0.7 |
| 9 | 8.3 | 3.5 | 6.3 | 2.0 |
| 10 | 6.2 | 4.1 | 5.6 | 1.5 |
| 11 | 10.8 | 5.0 | 12.0 | 1.0 |
| 12 | 9.9 | 5.3 | 11.5 | 1.3 |
| 13 | 9.8 | 5.2 | 11.3 | 1.2 |
| 14 | 9.6 | 4.2 | 7.7 | 1.2 |
| 15 | 9.0 | 3.6 | 6.5 | 1.0 |
| 16 | 8.4 | 3.0 | 4.4 | 1.0 |
| 17 | 11.0 | 9.5 | 23.5 | 6.3 |
| 18 | 9.2 | 8.6 | 15.8 | 5.6 |
| 19 | 7.7 | 6.4 | 9.9 | 4.8 |
| 20 | 11.0 | 9.8 | 24.5 | 6.2 |
| 21 | 10.7 | 9.7 | 23.4 | 6.2 |
| 22 | 12.3 | 8.7 | 30.7 | 8.0 |
| 23 | 10.0 | 7.5 | 20.6 | 6.0 |
| 24 | 6.9 | 5.4 | 8.1 | 3.7 |
| 25 | 11.9 | 9.6 | 35.7 | 6.4 |
| 26 | 8.1 | 7.0 | 15.4 | 5.1 |
| 27 | 6.9 | 4.0 | 7.1 | 3.7 |
| 28 | 10.7 | 9.9 | 27.3 | 6.3 |

It is noted from Table 2 that all kinds of hot working (extrusion, rolling, stamping, and pressing) increased the residual flux density and produced the magnetic anisotropy. Especially good results (or high energy product) are obtained with alloys containing Cu and Ga.

EXAMPLE 2

In this example, the casting was performed in the usual way. An alloy of the composition as shown in Table 3 was molten in an induction furnace and the melt was cast in a mold to develop columnar crystals. The resulting ingot underwent hot working (pressing) at a work rate higher than 50%. The ingot was annealed at 1000° C. for 24 hours for magnetization. The average particle diameter after annealing was about 15 μm. In the case of casting, there is obtained an plane anisotropic magnet making advantage of the anisotropy of columnar crystals, if it is fabricated into a desired shape without hot working.

Table 4 shows the results obtained with the samples which were annealed without hot working and the samples which were annealed after hot working.

TABLE 3

| No. | Composition |
|---|---|
| 1 | $Pr_{15}Fe_{77}B_8$ |
| 2 | $Nd_{10}Pr_5Fe_{81}B_4$ |
| 3 | $Ce_3Nd_{10}Pr_4Fe_{86}Co_{10}Al_2B_3$ |
| 4 | $Pr_{15}Fe_{80}Cu_1B_4$ |

TABLE 3-continued

| No. | Composition |
|---|---|
| 5 | $Pr_{17}Fe_{76}Cu_2B_5$ |
| 6 | $Pr_{17}Fe_{83}Co_{10}Cu_4B_6$ |
| 7 | $Nd_{17}Fe_{71}Cu_6B_6$ |
| 8 | $Nd_{17}Fe_{56}Co_{10}Ga_2B_5$ |
| 9 | $Pr_{15}Fe_{76}Ga_4B_5$ |
| 10 | $Nd_{15}Fe_{58}Co_{15}Ga_5B_5$ |
| 11 | $Pr_{17}Fe_{75}Cu_{1.5}Ga_{0.5}B_6$ |
| 12 | $Pr_{17}Fe_{75}Cu_2S_1B_5$ |
| 13 | $Pr_{17}Fe_{74}Cu_2S_2B_5$ |
| 14 | $Pr_{17}Fe_{74}Cu_2C_2B_5$ |
| 15 | $Pr_{17}Fe_{72}Cu_2C_4B_5$ |
| 16 | $Pr_{17}Fe_{74}Cu_2P_2B_5$ |
| 17 | $Pr_{17}Fe_{72}Cu_2P_4B_5$ |
| 18 | $Pr_{17}Fe_{72}Cu_2S_2C_2B_5$ |
| 19 | $Pr_{17}Fe_{72}Cu_2S_2P_2B_5$ |
| 20 | $Pr_{17}Fe_{72}Cu_2C_2P_2B_5$ |

TABLE 4

| | Without hot working | | | With hot working | | |
|---|---|---|---|---|---|---|
| No. | Br (KG) | iHc (KOe) | $(BH)_{max}$ (MGOe) | Br (KG) | iHc (KOe) | $(BH)_{max}$ (MGOe) |
| 1 | 2.3 | 1.0 | 0.8 | 10.8 | 7.8 | 14.7 |
| 2 | 6.6 | 9.2 | 6.4 | 12.2 | 14.8 | 28.1 |
| 3 | 6.2 | 9.4 | 6.4 | 11.0 | 15.8 | 24.2 |
| 4 | 6.7 | 12.0 | 7.9 | 12.6 | 14.0 | 36.1 |
| 5 | 7.5 | 10.0 | 10.5 | 13.5 | 12.3 | 43.0 |
| 6 | 7.0 | 7.0 | 6.9 | 12.5 | 10.0 | 28.9 |
| 7 | 6.2 | 6.3 | 5.1 | 10.0 | 7.3 | 15.1 |
| 8 | 7.6 | 12.5 | 9.4 | 13.4 | 10.1 | 42.3 |
| 9 | 6.8 | 7.2 | 7.1 | 12.0 | 9.1 | 26.5 |
| 10 | 6.3 | 6.7 | 5.6 | 9.8 | 5.7 | 12.4 |
| 11 | 8.0 | 12.0 | 11.0 | 13.7 | 15.1 | 45.1 |
| 12 | 7.0 | 6.7 | 7.0 | 11.8 | 7.9 | 30.0 |
| 13 | 6.1 | 5.4 | 5.0 | 9.7 | 5.2 | 15.0 |
| 14 | 7.0 | 6.2 | 6.8 | 11.7 | 7.2 | 28.0 |
| 15 | 5.3 | 5.0 | 4.4 | 9.8 | 5.9 | 13.5 |
| 16 | 6.9 | 6.7 | 7.0 | 11.4 | 8.0 | 29.0 |
| 17 | 5.7 | 5.3 | 5.1 | 10.0 | 6.1 | 14.0 |
| 18 | 5.6 | 5.0 | 5.6 | 9.8 | 6.5 | 14.9 |
| 19 | 6.3 | 6.7 | 6.0 | 9.7 | 6.0 | 13.1 |
| 20 | 6.0 | 6.1 | 5.0 | 9.5 | 7.1 | 12.1 |

It is noted from Table 4 that hot working increases both $(BH)_{max}$ and iHc to a great extent. This is due to the alignment of crystal grains by hot working., which in turn greatly improves the squareness of the $4\pi$ I-H loop. The large increase in iHc is a special feature of the present invention. In the case of process (3) mentioned above, hot pressing rather tends to decrease iHc. The results of this example indicate the adequate amount of Cu and the allowable limits of impurities such as C, S, and P.

EXAMPLE 3

Resin-bonded magnets were produced in the following four manners from the alloy of composition $Pr_{17}Fe_{75}Cu_{1.5}Ga_{0.5}B_6$ which exhibited the highest performance in Example 2.

(1) A cast ingot was repeatedly subjected to absorption of hydrogen (in hydrogen at about 10 atm) and dehydrogenation (in vacuum at $10^{-5}$ Torr) at room temperature in an 18-8 stainless steel vessel. The ingot was crushed in this process, and the powder was mixed with 2.5 wt % of epoxy resin. The mixture was molded into a cube with 15-mm sides in a magnetic field of 15 kOe. The average particle diameter of the powder was about 30 μm (measured with a Fisher Subsieve sizer).

(2) After hot working, an ingot was crushed into powder (having an average particle diameter of about 30

μm) by using a stamp mill and disk mill. The particle diameter of the $Pr_2Fe_{14}B$ phase in the grain was 2–3 μm. The powder was compression-molded in a magnetic field in the same manner as in (1) above.

(3) The powder prepared in (2) above was surface-treated with a silane coupling agent. The treated powder was mixed with 40 vol % of nylon-12 at about 250° C. The mixture was injection-molded into a cube with 15-mm sides in a magnetic field of 15 kOe.

(4) The powder prepared in (1) above was coated with Dy (about 0.5 μm thick) by high-frequency sputtering. Then, the powder was sealed together with argon in a cylindrical case and heated at 300° C. for 1 hour. The treated powder was made into a resin-bonded magnet in the same manner as in (1) above.

The results are shown in Table 5. It is noted that the process of the present invention permits the production of anisotropic resin-bonded magnets.

TABLE 5

| No. | Br(KG) | iHc(KOe) | $(BH)_{max}$(MGOe) |
|---|---|---|---|
| (1) | 9.6 | 8.7 | 21.5 |
| (2) | 9.8 | 10.5 | 24.0 |
| (3) | 7.5 | 11.0 | 12.8 |
| (4) | 9.4 | 14.3 | 20.1 |

EXAMPLE 4

The magnets (with hot working) of composition Nos. 1,4, and 10 in Example 2 were subjected to corrosion resistance test in a thermostatic bath at 60 C and 95%RH (Relative Humidity). The results are shown in Table 6.

TABLE 6

| Sample No. | Ratio of rusted surface | | |
|---|---|---|---|
| | 1 hr | 10 hrs | 1000 hrs |
| 1 | 30~40% | 70~80% | 100% |
| 4 | 0% | ~10% | 20~30% |
| 10 | ~5% | 10~20% | 30~40% |

The composition in sample No. 1 is a standard composition used for the powder metallurgy, and the compositions in samples Nos. 4 and 10 are suitable for use in the process of the present invention. It is noted from Table 6 that the magnets of the present invention have greatly improved corrosion resistance. It is thought that the improved corrosion resistance is attributable to Cu present in the grain boundary and the lower B content than in the composition No. 1. (In the low B conent composition range a boron-rich phase, which does not form passive state and causes corrosion, is not emerged.)

EXAMPLE 5

Magnets of the composition as shown in Table 7 were prepared in the same manner as in Example 2. The results are shown in Table 8. (No. 1 represents the comparative example.) It is noted that an additional element added in combination with Cu improves the magnetic properties, especially coercive force.

TABLE 7

| No. | Composition |
|---|---|
| 1 | $Pr_{17}Fe_{76.5}Cu_{1.5}B_5$ |
| 2 | $Pr_{17}Fe_{76}Cu_{1.5}Al_{0.5}B_5$ |
| 3 | $Pr_{17}Fe_{74.5}Cu_{1.5}Al_{2.0}B_5$ |
| 4 | $Pr_{17}Fe_{76}Cu_{1.5}Si_{0.5}B_5$ |

TABLE 7-continued

| No. | Composition |
|---|---|
| 5 | $Pr_{17}Fe_{74.5}Cu_{1.5}Si_{2.0}B_5$ |
| 6 | $Pr_{17}Fe_{76}Cu_{1.5}Zr_{0.5}B_5$ |
| 7 | $Pr_{17}Fe_{74.5}Cu_{1.5}Zr_{2.0}B_5$ |
| 8 | $Pr_{17}Fe_{76}Cu_{1.5}Hf_{0.5}B_5$ |
| 9 | $Pr_{17}Fe_{74.5}Cu_{1.5}Hf_{2.0}B_5$ |
| 10 | $Pr_{17}Fe_{76}Cu_{1.5}V_{0.5}B_5$ |
| 11 | $Pr_{17}Fe_{74.5}Cu_{1.5}V_{2.0}B_5$ |
| 12 | $Pr_{17}Fe_{76}Cu_{1.5}Nd_{0.5}B_5$ |
| 13 | $Pr_{17}Fe_{74.5}Cu_{1.5}Nd_{2.0}B_5$ |
| 14 | $Pr_{17}Fe_{76}Cu_{1.5}Cr_{0.5}B_5$ |
| 15 | $Pr_{17}Fe_{74.5}Cu_{1.5}Cr_{2.0}B_5$ |
| 16 | $Pr_{17}Fe_{76}Cu_{1.5}Mo_{0.5}B_5$ |
| 17 | $Pr_{17}Fe_{74.5}Cu_{1.5}Mo_{2.0}B_5$ |
| 18 | $Pr_{17}Fe_{76}Cu_{1.5}W_{0.5}B_5$ |
| 19 | $Pr_{17}Fe_{74.5}Cu_{1.5}W_{2.0}B_5$ |
| 20 | $Pr_{17}Fe_{76}Cu_{1.5}Mn_{0.5}B_5$ |
| 21 | $Pr_{17}Fe_{74.5}Cu_{1.5}Mn_{2.0}B_5$ |
| 22 | $Pr_{17}Fe_{76}Cu_{1.5}Bi_{0.5}B_5$ |
| 23 | $Pr_{17}Fe_{74.5}Cu_{1.5}Bi_{2.0}B_5$ |
| 24 | $Pr_{17}Fe_{76}Cu_{1.5}Ni_{0.5}B_5$ |
| 25 | $Pr_{17}Fe_{74.5}Cu_{1.5}Ni_{2.0}B_5$ |
| 26 | $Pr_{17}Fe_{76}Cu_{1.5}Ta_{0.5}B_5$ |
| 27 | $Pr_{17}Fe_{74.5}Cu_{1.5}Ta_{2.0}B_5$ |

TABLE 8

| No. | Without hot working | | | With hot working | | |
|---|---|---|---|---|---|---|
| | Br (KG) | iHc (KOe) | $(BH)_{max}$ (MGOe) | Br (KG) | iHc (KOe) | $(BH)_{max}$ (MGOe) |
| 1 | 7.6 | 10.5 | 10.0 | 13.5 | 12.3 | 43.0 |
| 2 | 7.5 | 12.7 | 10.6 | 13.3 | 15.0 | 42.1 |
| 3 | 6.5 | 12.6 | 9.0 | 12.5 | 15.4 | 36.7 |
| 4 | 7.2 | 11.5 | 10.3 | 13.2 | 15.6 | 40.7 |
| 5 | 6.9 | 10.9 | 9.5 | 12.0 | 14.0 | 34.6 |
| 6 | 7.4 | 13.1 | 10.8 | 13.0 | 14.2 | 39.5 |
| 7 | 6.8 | 12.0 | 8.7 | 12.4 | 12.8 | 36.0 |
| 8 | 7.3 | 13.0 | 10.2 | 13.1 | 13.8 | 40.2 |
| 9 | 7.0 | 12.1 | 9.0 | 11.9 | 12.0 | 33.0 |
| 10 | 7.5 | 13.7 | 9.7 | 12.8 | 14.9 | 38.0 |
| 11 | 6.8 | 11.6 | 8.0 | 11.8 | 13.1 | 32.5 |
| 12 | 7.6 | 13.6 | 10.8 | 13.6 | 14.0 | 43.6 |
| 13 | 6.7 | 12.6 | 9.4 | 12.9 | 12.6 | 40.0 |
| 14 | 7.0 | 11.0 | 9.0 | 11.5 | 13.0 | 30.0 |
| 15 | 6.0 | 10.7 | 8.0 | 10.5 | 12.4 | 26.3 |
| 16 | 7.6 | 11.8 | 9.6 | 12.6 | 13.7 | 36.0 |
| 17 | 6.6 | 11.0 | 8.2 | 11.2 | 12.1 | 28.4 |
| 18 | 8.0 | 13.0 | 9.3 | 12.1 | 13.7 | 34.6 |
| 19 | 7.0 | 12.3 | 7.9 | 10.7 | 12.8 | 26.6 |
| 20 | 7.4 | 10.7 | 9.8 | 12.4 | 12.8 | 34.0 |
| 21 | 6.3 | 10.0 | 7.7 | 10.9 | 11.5 | 27.5 |
| 22 | 7.0 | 12.5 | 8.6 | 12.5 | 13.8 | 30.7 |
| 23 | 6.2 | 11.4 | 7.0 | 10.6 | 12.9 | 24.5 |
| 24 | 7.8 | 13.5 | 11.0 | 13.5 | 13.9 | 43.8 |
| 25 | 7.4 | 12.8 | 10.4 | 12.8 | 12.9 | 35.8 |
| 26 | 7.4 | 12.7 | 8.5 | 12.0 | 13.1 | 34.0 |
| 27 | 6.8 | 10.8 | 7.0 | 10.5 | 12.5 | 26.0 |

We claim:

1. A rare earth-iron permanent magnet, comprising a cast ingot of an alloy consisting essentially of at least one rare earth element represented by R, and Fe, B, and Cu which has been subjected to hot working at 500° C. or above which finely refines the crystal grains and makes them magnetically anisotropic.

2. A rare earth-iron permanent magnet as claimed in claim 1, which has been subjected to heat treatment at 250° C. or above before and/or after the hot working.

3. A rare earth-iron permanent magnet as claimed in claim 1, the alloy includes essentially 8–30% of R, 2–28% of B, and 6% or less of Cu (by atomic percent), with the remainder being Fe and unavoidable impurities.

4. A rare earth-iron permanent magnet as claimed in claim 3, wherein the alloy includes 2 atomic % or less of S, 4 atomic % or less of C, and 4 atomic % or less of P as the unavoidable impurities.

5. A rare earth-iron permanent magnet as claimed in claim 3, wherein 50 atomic % or less of Fe is replaced by Co.

6. A rare earth-iron permanent magnet as claimed in claim 3, wherein the alloy contains about 6 atomic % or less of one or more than one element selected from the group consisting of Ga, Al, Si, Bi, V, Nb, Ta, Cr, Mo, W, Ni, Mn, Ti, Zr, and Hf.

7. A rare earth-iron permanent magnet as claimed in claim 3, wherein the R is one or more than one member selected from the group consisting of Pr, Nd, Pr-Nd alloy, and heavy rare earth elements.

8. An isotropic rare earth-iron permanent magnet having an improved coercive force comprising a cast ingot of an RFeB alloy having a main phase of $R_2Fe_{14}B_1$ consisting essentially of 8–30% of at least one rare earth element represented by R, 2–28% of B, and 6% or less of Cu, with the remainder being Fe and unavoidable impurities and which has been subjected to heat treatment at 250° C. or above.

9. A rare earth-iron permanent magnet as claimed in claim 8, wherein the alloy includes 8– 30% of R, 2–28% of B, and 6% or less of Cu (by atomic percent), with the remainder being Fe and unavoidable impurities.

10. A rare earth-iron permanent magnet as claimed in claim 9, wherein the alloy contains 2 atomic % or less of S, 4 atomic % or less of C, and 4 atomic % or less of P as the unavoidable impurities.

11. A rare earth-iron permanent magnet as claimed in claim 9, wherein 50 atomic % or less of Fe is replaced by Co.

12. A rare earth-iron permanent magnet as claimed in claim 9, wherein the alloy contains about 6 atomic % or less of one or more than one element selected from the group consisting of Ga, Al, Si Bi, V, Nb, Ta, Cr, Mo, W, Ni, Mn, Ti, Zr, and Hf.

13. A rare earth-iron permanent magnet as claimed in claim 9, wherein the R is one or more than one member selected from the group consisting of Pr, Nd, Pr-Nd alloy, and heavy rare earth elements.

14. An anisotropic powder bonded rare earth-iron permanent magnet which comprises a powder of an alloy composition consisting essentially of at least one rare earth element represented by R, and Fe, B, and Cu, said alloy formed by casting an ingot of said composition and pulverizing the case ingot to form the powder, and an organic binder, the magnet being anisotropic.

15. A rare earth-iron permanent magnet as claimed in claim 14, wherein the alloy has been cast and undergone hot working at 500° C. or above to make the ingot magnetically anisotropic and then crushed to form the powder.

16. A rare earth-iron permanent magnet as claimed in claim 14, wherein the alloy has been cast and undergone heat treatment at 250° or above.

17. A rare earth-iron permanent magnet as claimed in claim 14, wherein the alloy includes 8–30% of R, 2–28% of B, and 6% or less of Cu (by atomic percent), with the remainder being Fe and unavoidable impurities.

18. A rare earth iron permanent magnet as claimed in claim 17, wherein the alloy includes 2 atomic % or less of S, 4 atomic % or less of C, and 4 atomic % or less of P as the unavoidable impurities.

19. A rare earth-iron permanent magnet as claimed in claim 17, wherein 50 atomic % or less of Fe is replaced by Co.

20. A rare earth-iron permanent magnet as claimed in claim 17, wherein the alloy includes 6 atomic % or less of one or more than one element selected from the group consisting of Ga, Al, Si, Bi, V, Nb, Ta, Cr, Mo, W, Ni, Mn, Ti, Zr, and Hf.

21. A rare earth-iron permanent magnet as claimed in claim 17, wherein the R is one or more than one member selected from the group consisting of Pr, Nd, Pr-Nd alloy, and heavy rare earth elements.

22. A rare earth-iron permanent magnet as claimed in claim 3, wherein the R is one or more than one member selected from the group consisting of Pr, Nd, Ce-Pr-Nd alloy, and heavy rare earth elements.

23. A rare earth-iron permanent magnet as claimed in claim 9, wherein the R is one or more than one member selected from the group consisting of Pr, Nd, Ce-Pr-Nd alloy, and heavy rare earth elements.

24. A rare earth-iron permanent magnet as claimed in claim 17, wherein the R is one or more than one member selected from the group consisting of Pr, Nd, Ce-Pr-Nd alloy, and heavy rare earth elements.

* * * * *